US008953975B2

(12) United States Patent
Ohkubo et al.

(10) Patent No.: US 8,953,975 B2
(45) Date of Patent: Feb. 10, 2015

(54) SEAL AND IMAGE FORMING DEVICE INCLUDING A SEAL

(71) Applicants: Yasuhide Ohkubo, Toyonaka (JP); Ryouhei Ohi, Kyoto (JP); Yuusuke Furuichi, Ikeda (JP); Osamu Saito, Toyonaka (JP)

(72) Inventors: Yasuhide Ohkubo, Toyonaka (JP); Ryouhei Ohi, Kyoto (JP); Yuusuke Furuichi, Ikeda (JP); Osamu Saito, Toyonaka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/073,410

(22) Filed: Nov. 6, 2013

(65) Prior Publication Data

US 2014/0140722 A1 May 22, 2014

(30) Foreign Application Priority Data

Nov. 16, 2012 (JP) ..... 2012-252364

(51) Int. Cl.
*G03G 15/08* (2006.01)
*G03G 21/00* (2006.01)

(52) U.S. Cl.
CPC ..... *G03G 15/0898* (2013.01); *G03G 21/0011* (2013.01)
USPC ..... 399/102

(58) Field of Classification Search
CPC ..... G03G 15/0898; G03G 21/0011
USPC ..... 399/102
See application file for complete search history.

(56) References Cited

U.S. PATENT DOCUMENTS

| | | | | |
|---|---|---|---|---|
| 5,502,547 | A * | 3/1996 | Shirai | 399/102 |
| 5,655,178 | A * | 8/1997 | Ishikawa et al. | 399/102 |
| 2008/0038010 | A1* | 2/2008 | Ichikawa et al. | 399/100 |
| 2010/0028045 | A1 | 2/2010 | Kawakami et al. | |
| 2010/0215403 | A1* | 8/2010 | Aoshima | 399/174 |

FOREIGN PATENT DOCUMENTS

JP 10-301458 11/1998

* cited by examiner

*Primary Examiner* — David Gray
*Assistant Examiner* — Thomas Giampaolo, II
(74) *Attorney, Agent, or Firm* — Oblon, Spivak, McClelland, Maier & Neustadt, L.L.P.

(57) ABSTRACT

A seal includes a photoreceptor contacting portion to contact a photoreceptor, and a charge roller contacting portion to contact a charge roller. The photoreceptor contacting portion removes toner on the photoreceptor, and the charge roller contacting portion removes the toner on the charge roller, when the seal is mounted along the photoreceptor.

18 Claims, 5 Drawing Sheets

CONVENTIONAL EXAMPLE

SEAL AND IMAGE FORMING DEVICE INCLUDING A SEAL

CROSS-REFERENCE TO RELATED APPLICATIONS

This patent application is based on and claims priority to Japanese Patent Application Nos. 2012-252364, filed on Nov. 16, 2012 in the Japan Patent Office, the contents of which are hereby incorporated by reference herein in its entirety.

BACKGROUND

1. Field of Disclosure

This disclosure generally relates to a seal used in an image forming apparatus such as a printer, a facsimile machine, and a copier, a cleaning device including the seal and an image forming unit including the cleaning device.

2. Discussion of the Background Art

An electrophotographic device includes at least a charge device that charges a photoreceptor, an exposure device that forms a latent image on the photoreceptor, a developing device that adheres to toner on the latent image, and a photoconductive cleaning device that removes an untransferred toner on the photoreceptor.

The photoconductive cleaning device includes a cleaning member 54, which is an elastic plate, whose edge 54*a* contacts a photoreceptor 51 to scrape an untransferred toner, as shown in FIGS. 7,8, and 9. FIG. 7 shows a transfer roller 61, a charge roller 53, a developing roller 73, and a supply roller 74. The cleaning member 54 is a simple structure and reduces a size and a cost of the photoconductive cleaning device.

A sheet member 56 is arranged at an upstream side in a rotating direction of the photoreceptor 51 with respect to a contact portion at the photoreceptor 51 and an edge of the cleaning member 54. The sheet member 56, which is an elastic material, prevents toner scraped by the cleaning member 54 from falling to a transfer material. Thus, the toner scraped by the cleaning member 54 is accumulated in a space which is at an opposite side of the photoreceptor 51 with respect to the sheet member 56.

A seal member 57 that is an elastic material contacts the cleaning member 54, the sheet member 56, and an edge portion of the photoreceptor 51 in a longitudinal direction of a rotation axis as shown in FIGS. 9 and 10. The seal member 57 prevents toner scraped by the cleaning member 54 and toner accumulated the space from adhering to the photoreceptor 51 again.

Generally, the cleaning member 54 is made of a rubber plate. The sheet member 56 is an elastic sheet. The seal member is made of a material that combines a sponge with felt.

However, a gap occurs between the cleaning member 54 and the seal member 57. When the gap occurs, toner scraped by the cleaning member 54 is adhered to the photoreceptor 51 or the transfer material through the gap.

Japanese Unexamined Patent Application No. 10-301458 discloses an image forming apparatus that reduce the gap. In this apparatus, each of a first seal member and a second seal member, arranged on both sides in a longitudinal direction of a cleaning blade, presses to contact the cleaning blade and each of a first sidewall and a second sidewall. In case where Ta1 is a compressive deformation amount of the first seal member which receives a counterforce from the first sidewall, Ta2 is a compressive deformation amount of the second seal member which receives a counterforce from the second sidewall, and Tc is a swinging stroke of the cleaning blade, Ta1 is greater than Tc and Ta2 is greater than Tc.

SUMMARY

In an exemplary implementation, a seal includes a photoreceptor contacting portion to contact a photoreceptor, and a charge roller contacting portion to contact a charge roller. The photoreceptor contacting portion can remove toner on the photoreceptor, and the charge roller contacting portion can remove the toner on the charge roller, when the seal provided along the photoreceptor.

A cleaning device can include the seal and a cleaning member to remove toner on a surface of a photoreceptor. An image forming unit can include the cleaning device, a photoreceptor, and a charge device to charge the photoreceptor. An image forming apparatus can include the cleaning device and an image forming device to form an image.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF THE EXEMPLARY IMPLEMENTATIONS

Figure 1:
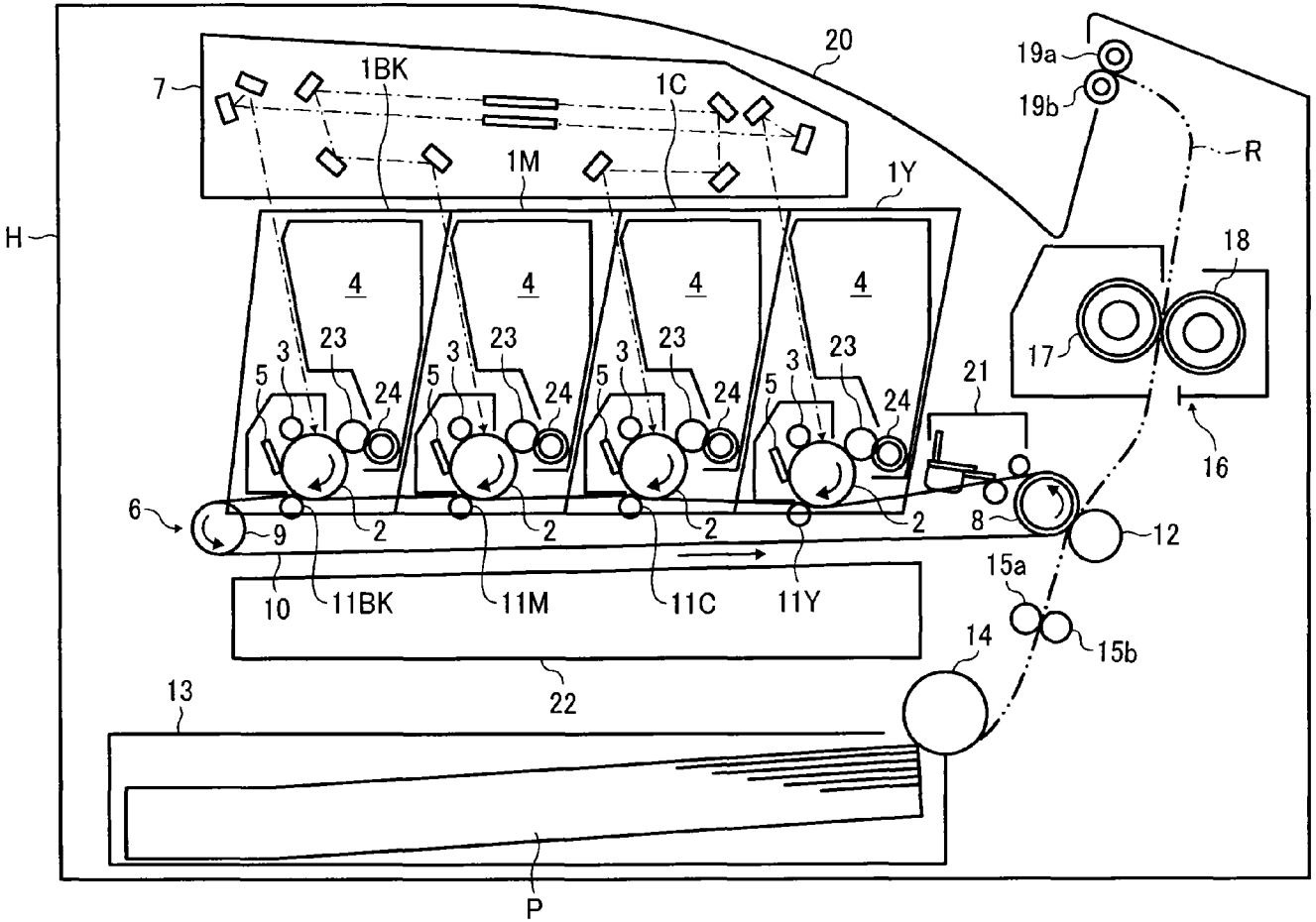
FIG. 1 is an overall view of an image forming apparatus.

In describing the implementations illustrated in the drawings, specific terminology is employed for the sake of clarity. However, this disclosure is not intended to be limited to the specific terminology so selected, and it is to be understood that each specific element includes all technical equivalents that operate in a similar manner and achieve a similar result.

FIG. 1 is an overall view of an image forming apparatus. The image forming apparatus in FIG. 1 includes process units 1Y, 1C, 1M, and 1BK. Each of the process units 1Y, 1C, 1M, and 1BK is detachable from an image forming apparatus body H.

Each of the process unit 1Y, 1C, 1M, and 1BK contains toner of yellow (Y), cyan (C), magenta (M), and black (BK). The process units 1Y, 1C, 1M, and 1BK are the same configuration except for the color of toner. Thus, instead of explaining each of the process units 1Y, 1C, 1M, and 1BK, the process unit 1Y is explained as follows.

The process unit 1Y includes a photoreceptor 2 as an image carrier, a charge roller 3 as a charge device that charges the photoreceptor 2, a developing device 4 that includes a developing roller 23 and forms a toner image on a surface of the photoreceptor 2, and a cleaning device 5 that removes untransferred toner on the surface of the photoreceptor 2.

Thus, each of the process unit 1Y, 1C, 1M, and 1BK is an image forming unit including at least the photoreceptor 2, the charge roller 3, the developing roller 23, and the cleaning device 5.

An exposure device 7, which irradiates a writing laser beam on a surface of the photoreceptor 2, is arranged above the process units 1Y, 1C, 1M, and 1BK. An intermediate transfer unit 6 is arranged below each of the process unit 1Y, 1C, 1M, and 1BK. The intermediate transfer unit 6 includes an intermediate transfer belt 10 that is an endless belt. The intermediate transfer belt 10 is wrapped around a drive roller 8 and a driven roller 9, and rotates in a rotating direction of an arrow of the drive roller 8 and the driven roller 9 as shown in FIG. 1.

Primary transfer rollers 11Y, 11C, 11M, and 11BK are arranged inside of the intermediate transfer belt 10. Each of the primary transfer roller 11Y, 11C, 11M, and 11BK contacts an inside surface of the intermediate transfer belt 10. The photoreceptors 2 and the primary transfer rollers 11Y, 11C, 11M, and 11BK respectively face each other via the intermediate transfer belt 10. Thus, a primary transfer nip is formed at a portion where each of the photoreceptors 2 contacts an outer surface of the intermediate transfer belt 10.

A secondary transfer roller 12 and the drive roller 8 are arranged to face each other via the intermediate transfer belt 10. A secondary transfer nip is formed at a portion where the secondary transfer roller 12 contacts an outer surface of the intermediate transfer belt 10. A belt-cleaning device 21 is arranged to contact an outer surface of the intermediate transfer belt 10.

A waste toner container 22, which contains waste toner removed by the belt-cleaning device 21, is arranged below the intermediate transfer unit 6 in FIG. 1. The waste toner transfer tube connects to the waste toner container 22.

A sheet tray 13, which contains sheets P of transfer material such as paper or overhead projector (OHP) films, is arranged below the image forming apparatus body H. The sheet tray 13 includes a feed roller 14 to pick up and convey the sheets P.

A conveyance path R proceeds upwardly from the lower part of the image forming apparatus body H in FIG. 1. A pair of registration rollers 15*a* and 15*b* is arranged upstream of the secondary transfer roller 12 in a direction that the sheet P is conveyed. A fixing device 16 is arranged downstream of the secondary transfer roller 12 in the direction that the sheet P is conveyed. The fixing device 16 includes a heat roller 17 and a pressure roller 18. A fixing nip is formed at a portion where the heat roller 17 contacts the pressure roller 18.

A pair of discharge rollers 19*a* and 19*b* is arranged downstream of the fixing device 16 in the direction that the sheet P is conveyed. Upper surface of the image forming apparatus body H forms a sheet stacking tray 20 to stack the sheets P discharged from the discharge rollers 19*a* and 19*b*.

The image forming apparatus configured as described above operates as follows.

When image formation is started, the photoreceptors 2 in the respective process units 1Y, 1C, 1M, and 1BK rotate in a clockwise direction in FIG. 1, and the charge roller 3 uniformly charges a surface of the photoreceptors 2 to a predetermined polarity. Then, exposure device 7 irradiates the writing laser beam on the surface of the photoreceptors 2 based on image data. Thus, an electrostatic latent image is formed on the photoreceptors 2. The electrostatic latent images formed on the photoreceptors 2 are developed into toner images with toner supplied by the respective developing devices 4. The developing devices 4 include developing rollers 23 to form a visible image on the photoreceptors 2 and supply rollers 24 to supply toner to the developing rollers 23.

The primary transfer rollers 1Y, 1C, 1M, and 1BK have applied thereto a constant voltage that is controlled to be a reverse polarity to the polarity of toner, or a voltage that is controlled in a constant-current control. Thus, the primary transfer nips, which are formed between the primary transfer rollers 11Y, 1C, 1M, and 1BK and the photoreceptors 2, are applied with transfer electric fields. Then, the intermediate transfer belt 10 has transferred thereto the toner image via the primary transfer nips.

The cleaning devices 5 remove the untransferred toner on the photoreceptor 2 after the primary transfer process as mentioned above. Moreover, a charge-removing device removes a residual electrostatic potential on the surface of the photoreceptor 2.

Alternatively, the feed roller 14 rotates and feeds the sheet P to the conveyance path R. After that, the sheet P stops at the registration rollers 15*a* and 15*b*.

The secondary transfer roller 12 is applied with a voltage, which is a reverse polarity to the polarity of toner. Thus, the secondary transfer nip, which is between the secondary transfer roller 12 and the intermediate transfer belt 10, has a transfer electric field. The drive roller 8 may be applied with a voltage which is a same polarity as the polarity of the toner.

After that, the registration rollers 15*a* and 15*b* start to rotate, and convey the sheet P to the secondary transfer nip in correspondence with a toner image on the intermediate transfer belt 10. Then the toner image on the intermediate transfer belt 10 is transferred to the sheet P using the transfer electric field of the secondary transfer nip. After the secondary transfer process described above, the belt-cleaning device 21 removes a remaining untransferred toner on the surface of the intermediate transfer belt 10, and the waste toner container 22 collects the untransferred toner removed by the belt-cleaning device 21.

The sheet P having the toner image transferred thereto is fed to the fixing device 16. The sheet P fed to the fixing device 16 is applied with heat and pressure at the heat roller 17 and the pressure roller 18 to fix the toner image on the sheet P. After that, the discharge rollers 19*a* and 19*b* discharge the sheet P to the sheet stack tray 20.

Figure 2:
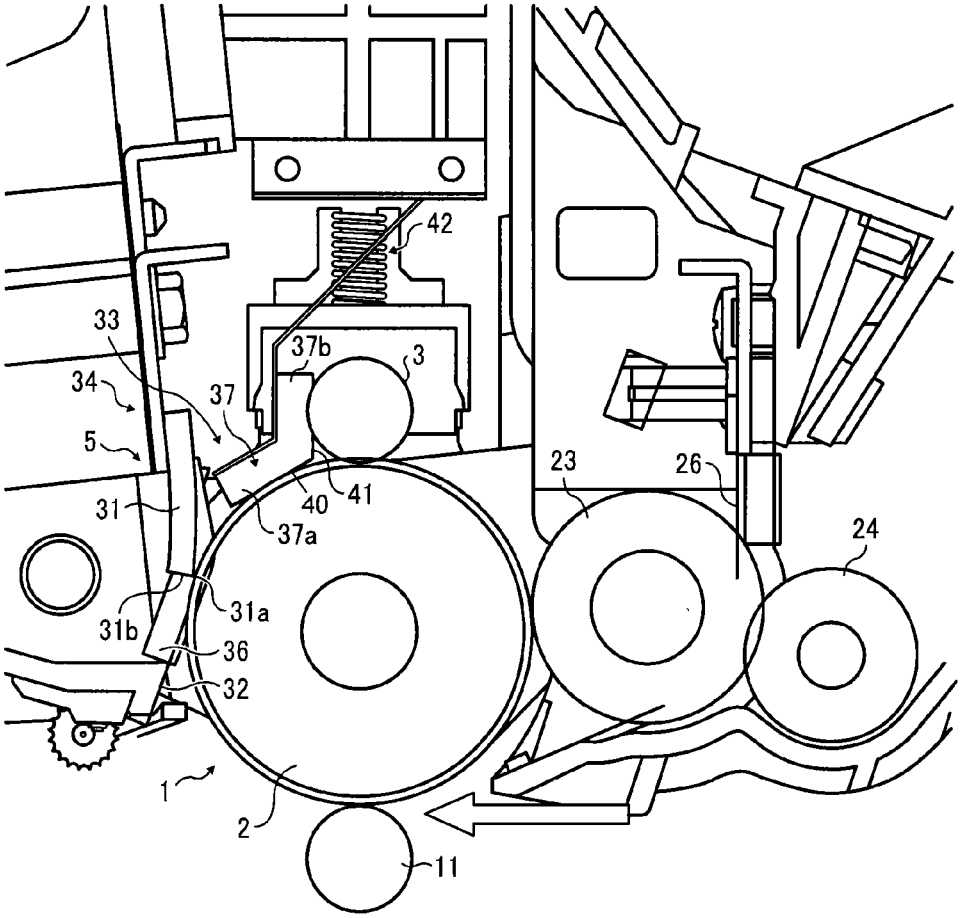
FIG. 2 is an enlarged view of the image forming apparatus.

FIG. 2 is an enlarged view of the image forming apparatus.

The supply roller 24 supplies toner for the developing roller 23, and a toner layer is formed on the developing roller 23. A regulating blade 26 contacts the developing roller 23 with a predetermined force under bended state. The regulating blade 26 regulates a quantity of the toner layer, and forms a toner thin layer. The developing roller 23 contacts the photoreceptor 2 with a predetermined force, and toner on the developing roller 23 moves to the photoreceptor 2 according to a potential difference between the photoreceptor 2 and the developing roller 23. The primary transfer roller 11 contacts the photoreceptor 2 with a predetermined force through the intermediate transfer belt 10. The intermediate transfer belt 10 has transferred thereto a toner image at a nip which is between the primary transfer roller 11 and the photoreceptor 2. However, some untransferred toner remains on the photoreceptor 2.

Figure 3:
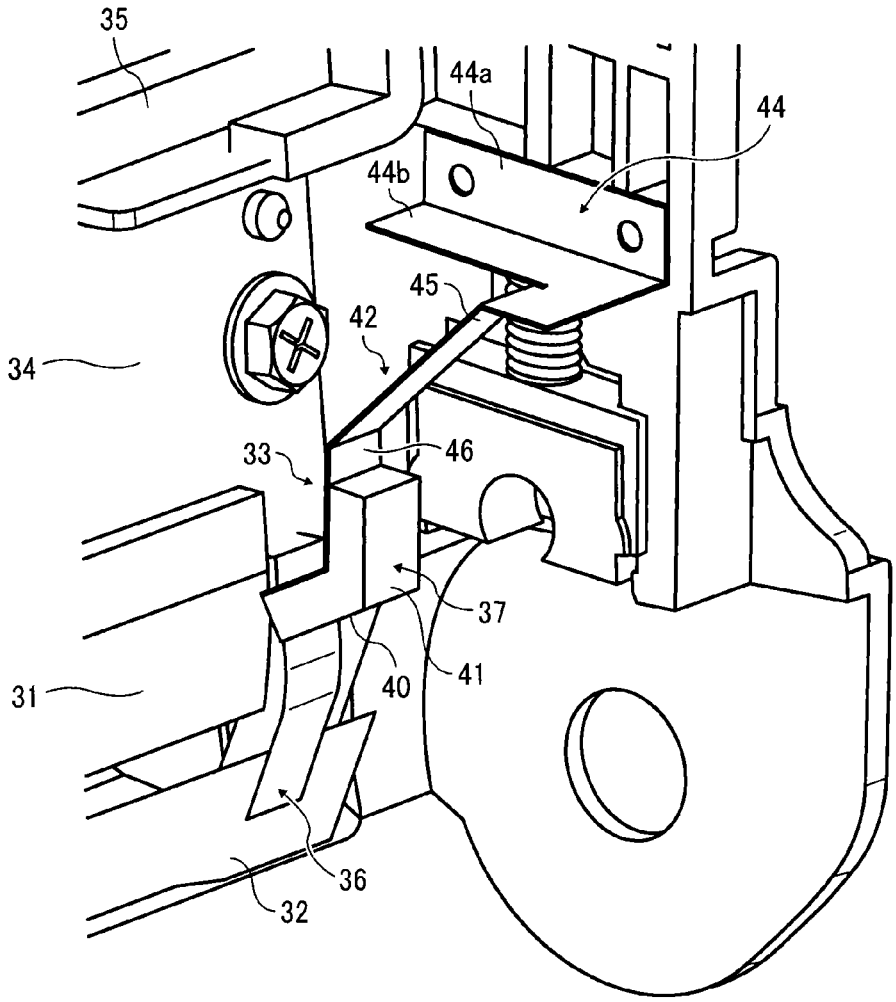
FIG. 3 is a perspective view of a cleaning device of the image forming apparatus.
Figure 4:
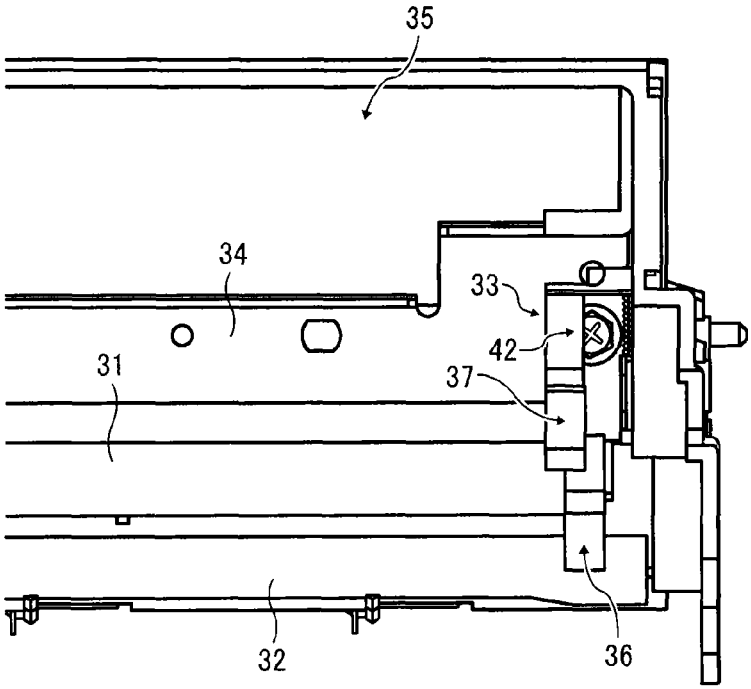
FIG. 4 is an elevation view of the cleaning device.

Therefore, the image forming apparatus includes the cleaning device 5 as mentioned above. As shown in FIGS. 2, 3, and 4, the cleaning device 5 includes a cleaning blade 31 as a cleaning member that removes the untransferred toner on a surface of the photoreceptor 2, a sheet member 32 that prevents the untransferred toner scraped by the cleaning blade 31 from falling to the sheet P, and a seal structure 33. The seal structure 33 prevents a collected toner from overflowing in a longitudinal direction of the sheet member 32. The seal structure 33 includes a first seal 36 and a second seal 37 which are described below.

The cleaning blade 31 is made of a rubber plate that is an elongated rectangular shape along a longitudinal direction of the photoreceptor 2. Moreover, the cleaning blade 31 is supported by and bonded to a holder 34 that is a rigid body. The cleaning blade 31 contacts the photoreceptor 2 with a predetermined force and angle. The cleaning blade 31 bends in orthogonally to a lengthwise direction of the photoreceptor 2 (an outer side in a radial direction of the photoreceptor 2) in FIG. 2, and a long side edge 31 a of the cleaning blade 31 contacts the photoreceptor 2. The long side edge 31 a scrapes toner on the photoreceptor 2. The holder 34 is fixed to a waste toner case 35 in FIGS. 3 and 4.

Thus, regarding toner scraped by the cleaning blade 31, a part of the toner adhered to the cleaning blade 31 and the others fall below the cleaning blade 31. The sheet member 32 blocks a space to prevent the toner from falling to the sheet P. When the toner scraped by the cleaning blade 31 increases gradually, the toner is accumulated at a space which is at an opposite side of the photoreceptor 2 with respect to the cleaning blade 31 and the sheet member 32. The cleaning blade 31 removes almost all toner on the photoreceptor 2. After that, the photoreceptor 2 is charged by the charge roller 3 in FIG. 2, irradiated by the exposure device 7 in FIG. 1, and developed by the developing roller 23 in FIG. 2.

When the toner scraped by the long side edge 31 a of the cleaning blade 31 is adhered to the cleaning blade 31 and increases gradually, a toner accumulation area of the scraped toner expands to an opposite side of the photoreceptor 2 with respect to the cleaning blade 31 and an end portion in the longitudinal direction of the cleaning blade 31. Thus, the first seal 36 of the seal structure 33 is arranged at the end portion in the longitudinal direction of the cleaning blade 31 and prevents the toner of the toner accumulation area from overflowing in the longitudinal direction and adhering the photoreceptor 2.

The first seal 36 is an elastic member. The first seal 36 contacts the photoreceptor 2 with a predetermined force and is compressed. Thus, a material of the first seal 36 preferably has both a low frictional force and does not pass through the nip between the photoreceptor 2 and the first seal 36 because a surface at which the first seal 36 contacts the photoreceptor 2 is subject to a frictional force for a long-term. For example, the first seal 36 can be made of felt as a raised material. However, a sponge is attached to the felt whose surface is on an opposite side of the photoreceptor 2 because it is possible to implement the invention, if desired, so that only the raised material is not elastic. It is possible to change the abutting pressure by changing a thickness or material of the sponge.

When the first seal 36 contacts the cleaning blade 31 with a predetermined force, the seal is affected by contacting pressure from the cleaning blade 31 to the photoreceptor 2. Thus, a cleaning property may be decreased by changing an edge of a contacting condition between the cleaning blade 31 and the photoreceptor 2. When a contacting surface of the first seal 36 contacting the photoreceptor 2 is felt, a part of the felt is nipped between the cleaning blade 31 and the photoreceptor 2. Thus, a gap occurs between the cleaning blade 31 and the photoreceptor 2, and toner may pass through the gap. Therefore, it is undesirable to have the first seal 36 contact the cleaning blade 31. Therefore, a small gap occurs between the first seal 36 and the cleaning blade 31. When there is a small gap, toner adhered to the edge of the cleaning blade 31 is pushed from the small gap to the photoreceptor 2, and toner is adhered to the photoreceptor 2. The toner on the photoreceptor 2 is transferred to the charge roller 3, and the charger roller 3 is soiled by the toner. When the charge roller 3 is soiled, a contacting condition between the charge roller 3 and the photoreceptor 2 changes because the toner is nipped between the photoreceptor 2 and the charge roller 3. Thus, a charge function decreases, and an abnormal image is produced.

Figure 6:
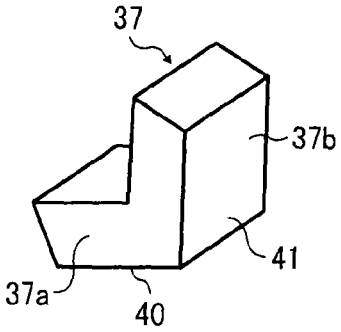
FIG. 6 is a perspective view of the second seal member of the cleaning device.
Figure 7:
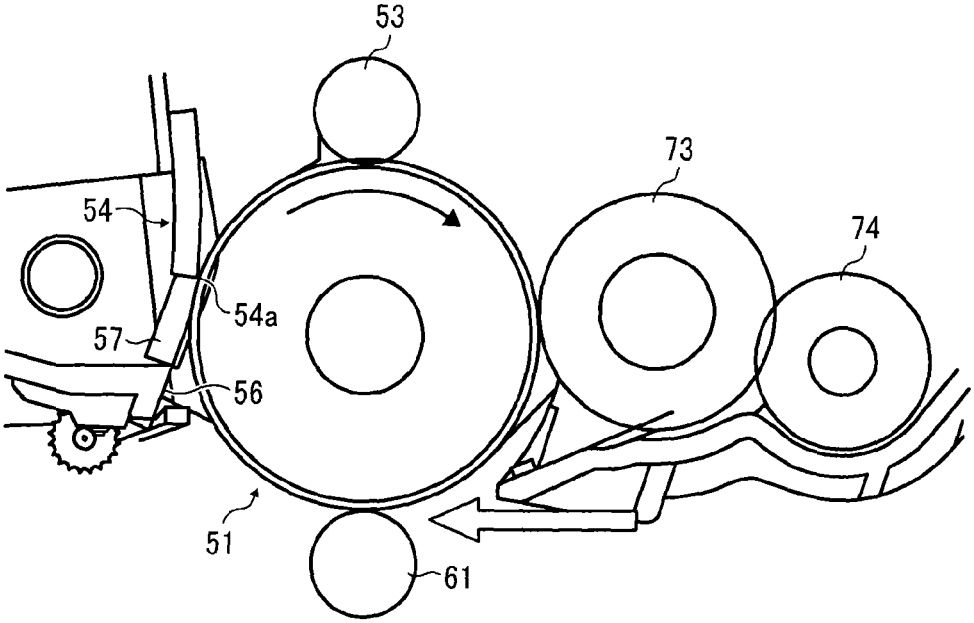
FIG. 7 is an enlarged view of a conventional image forming apparatus.

To prevent the occurrence of these issues, the seal structure 33 includes the second seal 37. The second seal 37 is arranged at a downstream side in a rotating direction of the photoreceptor 2 with respect to the first seal 36 in FIG. 2. The second seal 37 is located at a position that spans between the cleaning blade 31 and the first seal 36 in the longitudinal direction in FIG. 4. The second seal 37 includes an inclined portion 37*a* and a vertical portion 37*b* that are arranged in roughly an L-shaped cross-section, as shown in FIGS. 2 and 6. An outer surface of the inclined portion 37*a* is a photoreceptor contacting portion 40 that contacts the photoreceptor 2. An outer surface of the vertical portion 37*b* is a charge roller contacting portion 41 that contacts the charge roller 3. The photoreceptor contacting portion 40 and the charger roller contacting portion 41 may be considered planes, even though they are formed or deformed upon contact into curved surfaces. Based on the illustrations of FIGS. 2, 3, and 6, a plane corresponding to the photoreceptor contacting portion 40 and a plane corresponding to the charger roller contact portion 41 intersect at a line, and that line is parallel to an axis of rotation of the charge roller 3 and the axis of rotation of the photoreceptor 2.

According to an embodiment of the invention, the second seal 37 has a unitary structure, as shown in FIGS. 2, 3, and 6. By having a unitary structure, the second seal 37 is not two separate pieces, although the second seal 37 could be formed of two or more separate pieces which are glued or attached to each other such that when handled or installed in an image forming apparatus are one piece.

Figure 5:
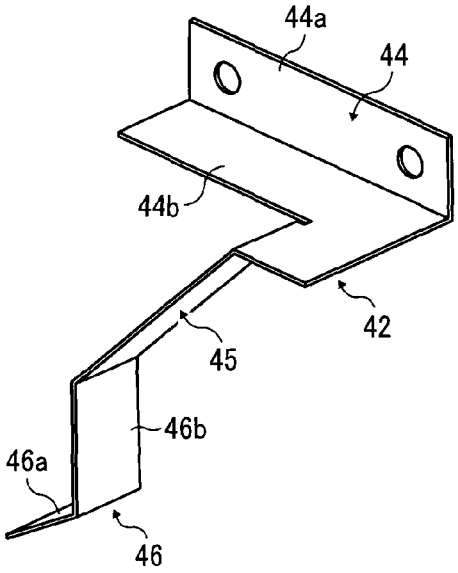
FIG. 5 is a perspective view of a support member of a second seal member of the cleaning device.

The second seal 37 is supported by a flat spring 42 which is a support member shown in FIG. 5. The flat spring 42 includes a supporting body 44, an inclined wall 45 extended obliquely downward from the supporting body 44, and a seal holding part 46 located below the inclined wall 45. Namely, the supporting body 44 includes a vertical wall portion 44*a* fixed to the waste toner case 35, and a horizontal wall portion 44*b* orthogonal to the vertical wall portion 44*a*. The seal holding part 46 includes a suspended wall 46*b* extending downward from a bottom edge of the inclined wall 45, and an inclined wall 46*a* extending obliquely downward from the suspended wall 46*b*.

An inner surface of the inclined portion 37*b* is adhered to the suspended wall 46*b* of the seal holding part 46. An inner surface of the vertical portion 37*a* is adhered to the inclined wall 46*a* of the seal holding part 46.

The second seal 37 includes a sponge and felt, like the first seal 36. The sponge is attached to felt whose surface is at an opposite side of the photoreceptor 2. When the second seal 37 contacts the photoreceptor 2 with a predetermined force, this force compresses the second seal 37 to a predetermined thickness. The second seal 37 removes toner that leaks from the gap between the cleaning blade 31 and the first seal 36, and collects the toner at the surface thereof. However, there is a limit to the amount of toner which can be collected by the second seal member 37. Thus, when the collected toner or developer exceeds the collection limit, toner may pass by the seal member 37. Thus, in the case where the second seal member 37 contacts a long area of the photoreceptor 2 in the rotating direction of the photoreceptor 2, it is possible to have a long time before the toner passes by the second seal member 37 due to an increasing amount of toner collected by the second seal member 37. However, a length of the second seal member 37 is limited by a circumference of the photoreceptor 2. A cleaning effect of the photoreceptor contacting portion 40 of the second seal 37 is, according to one implementation, less than the cleaning blade 31, and a small amount of toner passes by the second seal member. Thus, the second seal member 37 includes a charge roller contacting portion 41 which contacts the charge roller 3.

In a case where the toner passes by the second seal 37 and adheres to the charge roller 3, a charge roller contacting portion 41 removes and collects the toner on a surface of the charge roller 3. Thus, the configuration prevents soiling of the charge roller 3 with a high probability. It is possible to adjust a contact condition of the photoreceptor 2 and the photoreceptor contacting portion 40, and the charge roller 3 and the charge roller contacting portion 41 because a surface material of the photoreceptor 2 and the charge roller 3 is different. Thus, the contact force of the charge roller 3 is less than that of the photoreceptor 2.

The charge roller 3 is driven by a friction force from the photoreceptor 2 that occurs due to contact between the charge roller 3 and the photoreceptor 2. In the case where the contact force is large, the charge roller 3 is prevented from rotating according to friction from the second seal 37. Thus, the friction force may be small. Then, it is possible to adjust the friction force of the photoreceptor 2 and the photoreceptor contacting portion 40, the charge roller 3 and the charge roller contacting portion 41 according to shape and elastic force of the flat spring 42. It is also possible to change a material of the contact surface of the photoreceptor 2 and the charge roller 3.

According to a seal structure 33 of the present implementation, it is possible to prevent toner, which is scraped by the cleaning blade 31, from adhering to the photoreceptor 2 again. Moreover, in a case where a gap occurs between the cleaning blade 31 and the first seal 36, and toner adheres to the photoreceptor 2 via the gap, the photoreceptor contacting portion 40 of the second seal 37, which spans between the cleaning blade 31 and the first seal 36 in the longitudinal direction in FIG. 4, is able to remove the toner on the photoreceptor 2. Moreover, in a case where toner on the photoreceptor 2 transfers to the charge roller 3, the charge roller contacting portion 41 removes the toner on the charge roller 3. Thus, the image forming apparatus including the cleaning device including the seal structure 33 prevents the toner from adhering to the photoreceptor 2 and is stable to print for a long time.

In case where the second seal 37 exists, it does not matter if there exists a gap between the first seal 36 and the cleaning blade 31. Thus, if desired, a structure and arrangement of the second seal 37 may consider a seal effect and a material durability of the first seal 36. It may also be possible to give less consideration to a contact condition between the first seal 36 and the cleaning blade 31. Thus, the seal structure 33 may be designed according to increasing a material option of the first seal 36, and it may reduce a cost of the seal structure 33. Moreover, it is possible to maintain a stable charge function for a long time. In a case where a process unit includes the seal structure 33, it is possible to extend a lifetime of the process unit.

In a case where the first seal 36 and the second seal 37 are made of same material, the design and cost of the system may be improved.

In a case where the photoreceptor contacting portion 40, a charge roller contacting portion 41, and a contact surface of the first seal 36 are made of felt, it is possible to reduce friction with the photoreceptor 2. Moreover, it may be possible to collect more toner, and scrape the toner with high precision, according to the invention.

According to the second seal 37, it is possible to set a different contact force between the photoreceptor contacting portion 40 and the charge roller contacting portion 41. Further, it is possible to design a suitable sealing structure for the photoreceptor 2 and the charge roller 3 which have different exterior surfaces.

The toner may include silica-containing oil as an external additive. The external additive may include fine particles of an average primary particle diameter of 10 to 500 nm. Moreover, the external additive can create toner fluid, and prevent the toner from blocking. Thus, the image forming apparatus improves charge control, transfer efficiency, and cleaning performance.

The toner is not limited to the specific examples described above, and various types of toner and/or developer may be used the image forming apparatus may be used.

Obviously, numerous modifications and variations of the present invention are possible in light of the above teachings. It is therefore to be understood that within the scope of the appended claims, the invention may be practiced otherwise than as specifically described herein.

What is claimed is:

1. A seal structure, comprising:

a seal, the seal including a first contact surface to contact a photoreceptor and a second contact surface to contact a charging roller, the first contact surface and the second contact surface being part of a unitary structure, the first contact surface and the second contact surface arranged in a manner to respectively contact the photoreceptor and the charger roller which have parallel axes of rotation, wherein:

a first plane corresponds to a place of contact of the first contact surface and a second plane corresponds to a place of contact of the second contact surface, the first and second planes intersect at a line, and the line is parallel to the axis of rotation of the photoreceptor and the axis of rotation of the charging roller.

2. The seal structure of claim 1, wherein:

an angle formed by the first plane and the second plane is less than 180 degrees and greater than 90 degrees.

3. The seal structure of claim 1, further comprising:

another seal, separate from said seal, to contact the photoreceptor, said another seal to prevent toner from overflowing in a longitudinal direction of a cleaning member.

4. The seal structure of claim 1, wherein:

the first contact surface and the second contact surface comprise felt.

5. The seal structure of claim 1, wherein:

the seal has an L-shaped cross-section, the L-shaped cross-section including the first contact surface and the second contact surface.

6. An image forming device, comprising:

a photoconductive drum;

a charging roller to charge the photoconductive drum; and a seal, the seal including a first contact surface to contact the photoconductive drum and a second contact surface to contact the charging roller, wherein:

the first contact surface and the second contact surface are part of a unitary structure, the first contact surface and the second contact surface are arranged in a manner to respectively contact the photoconductive drum and the charging roller which have parallel axes of rotation, a first plane corresponds to a place of contact of the first contact surface and a second plane corresponds to a place of contact of the second contact surface, the first and second planes intersect at a line, and the line is parallel to the axis of rotation of the photoconductive drum and the axis of rotation of the charging roller.

7. The image forming device of claim 6, wherein:

an angle formed by the first plane and the second plane is less than 180 degrees and greater than 90 degrees.

8. The image forming device of claim 6, further comprising:

another seal, separate from said seal, to contact the photoconductive drum, said another seal to prevent toner from overflowing in a longitudinal direction of a cleaning member.

9. The image forming device of claim 8, wherein:

a length of said another seal corresponds to a length of said photoconductive drum.

10. The image forming device of claim 9, wherein:

said seal is located at an end portion of the photoconductive drum without being at a middle portion of the photoconductive drum.

11. The image forming device of claim 8, further comprising:

a cleaning member to remove toner on a surface of the photoconductive drum.

12. The image forming device of claim 8, wherein:

the seal is at a downstream side in a rotating direction of the photoconductive drum with respect to said another seal, and a contact force of the first contact surface against the photoconductive drum and a contact force of the second contact surface against the charging roller are different.

13. The image forming device of claim 6, wherein:

said seal is located at an end portion of the photoconductive drum without being at a middle portion of the photoconductive drum.

14. The image forming device of claim 13, wherein said image forming device comprises two of said seals, said seals being disposed a corresponding end portions of the photoconductive drum without being at a middle portion of the photoconductive drum.

15. The image forming device of claim 6, wherein:

the seal has an L-shaped cross-section, the L-shaped cross-section including the first contact surface and the second contact surface.

16. An image forming device, comprising:

a photoconductive drum;

a charging roller to charge the photoconductive drum; and a seal, the seal including a first contact surface to contact the photoconductive drum and a second contact surface to contact the charging roller, wherein the first contact surface and the second contact surface are part of a unitary structure, and wherein the first contact surface and the second contact surface are arranged in a manner to respectively contact the photoconductive drum and the charging roller which have parallel axes of rotation, the image forming further comprising another seal, separate from said seal, to contact the photoconductive drum, said another seal to prevent toner from overflowing in a longitudinal direction of a cleaning member, wherein:

the seal is at a downstream side in a rotating direction of the photoconductive drum with respect to said another seal, and a contact force of the first contact surface against the photoconductive drum and a contact force of the second contact surface against the charging roller are different, and the contact force of the first contact surface is greater than the contact force of the second contact surface.

17. The image forming device according to claim 16, wherein the first contact surface inclines against the second contact surface.

18. An image forming device, comprising:

a photoconductive drum;

a charging roller to charge the photoconductive drum; and a seal, the seal including a first contact surface to contact the photoconductive drum and a second contact surface to contact the charging roller, wherein:

the first contact surface and the second contact surface are part of a unitary structure, the first contact surface and the second contact surface are arranged in a manner to respectively contact the photoconductive drum and the charging roller which have parallel axes of rotation, the second contact surface is downstream from the first contact surface relative to a rotational direction of the photoconductive drum, and the second contact surface projects away from the photoconductive drum.

* * * * *

UNITED STATES PATENT AND TRADEMARK OFFICE

CERTIFICATE OF CORRECTION

PATENT NO. : 8,953,975 B2
APPLICATION NO. : 14/073410
DATED : February 10, 2015
INVENTOR(S) : Yasuhide Ohkubo et al.

It is certified that error appears in the above-identified patent and that said Letters Patent is hereby corrected as shown below:

TITLE PAGE

Delete Title Page, and replace with new Title Page indicating 6 Drawing Sheets. (Attached).

IN THE DRAWINGS

Figure 8:
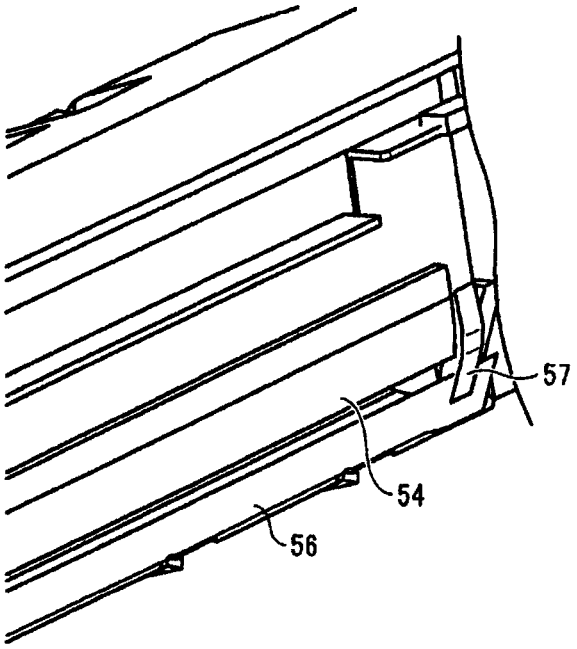
FIG. 8 is a perspective view of a conventional cleaning device in FIG. 7.
Figure 9:
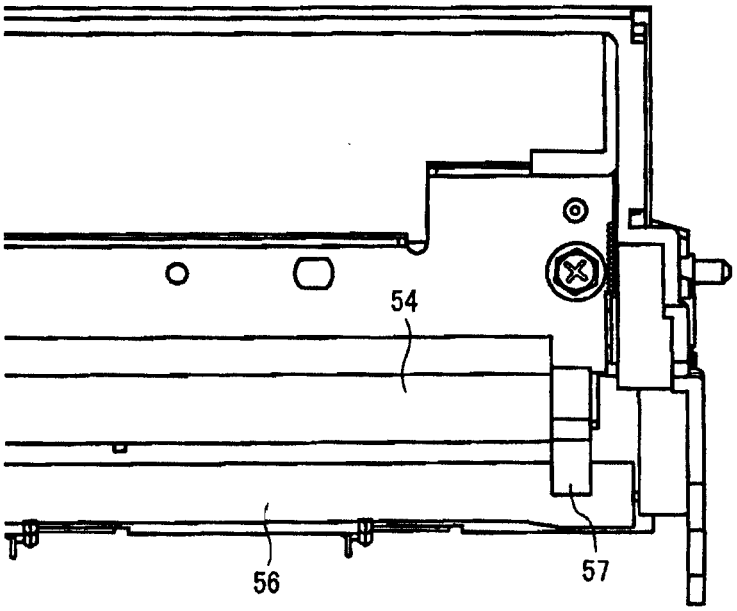
FIG. 9 is an elevation view of the conventional cleaning device in FIG. 7.

Add Drawing Sheet 6 consisting of Drawing Figures 8 & 9, as Drawing Sheet 6 of 6. (Attached).

Renumber Drawing Sheets as follows; 1 of 6, 2 of 6, 3 of 6, 4 of 6, 5 of 6 & 6 of 6.

Signed and Sealed this
Ninth Day of June, 2015

Michelle K. Lee

Michelle K. Lee
*Director of the United States Patent and Trademark Office*

(12) United States Patent
Ohkubo et al.

(10) Patent No.: US 8,953,975 B2
(45) Date of Patent: Feb. 10, 2015

(54) SEAL AND IMAGE FORMING DEVICE INCLUDING A SEAL

(71) Applicants: Yasuhide Ohkubo, Toyonaka (JP); Ryouhei Ohi, Kyoto (JP); Yuusuke Furuichi, Ikeda (JP); Osamu Saito, Toyonaka (JP)

(72) Inventors: Yasuhide Ohkubo, Toyonaka (JP); Ryouhei Ohi, Kyoto (JP); Yuusuke Furuichi, Ikeda (JP); Osamu Saito, Toyonaka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/073,410

(22) Filed: Nov. 6, 2013

(65) Prior Publication Data

US 2014/0140722 A1 May 22, 2014

(30) Foreign Application Priority Data

Nov. 16, 2012 (JP) ..... 2012-252364

(51) Int. Cl.
*G03G 15/08* (2006.01)
*G03G 21/00* (2006.01)

(52) U.S. Cl.
CPC ..... *G03G 15/0898* (2013.01); *G03G 21/0011* (2013.01)
USPC ..... 399/102

(58) Field of Classification Search
CPC ..... G03G 15/0898; G03G 21/0011
USPC ..... 399/102
See application file for complete search history.

(56) References Cited

U.S. PATENT DOCUMENTS

| | | | | |
|---|---|---|---|---|
| 5,502,547 | A * | 3/1996 | Shirai | 399/102 |
| 5,655,178 | A * | 8/1997 | Ishikawa et al. | 399/102 |
| 2008/0038010 | A1 * | 2/2008 | Ichikawa et al. | 399/100 |
| 2010/0028045 | A1 | 2/2010 | Kawakami et al. | |
| 2010/0215403 | A1 * | 8/2010 | Aoshima | 399/174 |

FOREIGN PATENT DOCUMENTS

| | | |
|---|---|---|
| JP | 10-301458 | 11/1998 |

* cited by examiner

*Primary Examiner* — David Gray
*Assistant Examiner* — Thomas Giampaolo, II
(74) *Attorney, Agent, or Firm* — Oblon, Spivak, McClelland, Maier & Neustadt, L.L.P.

(57) ABSTRACT

A seal includes a photoreceptor contacting portion to contact a photoreceptor, and a charge roller contacting portion to contact a charge roller. The photoreceptor contacting portion removes toner on the photoreceptor, and the charge roller contacting portion removes the toner on the charge roller, when the seal is mounted along the photoreceptor.

18 Claims, 6 Drawing Sheets

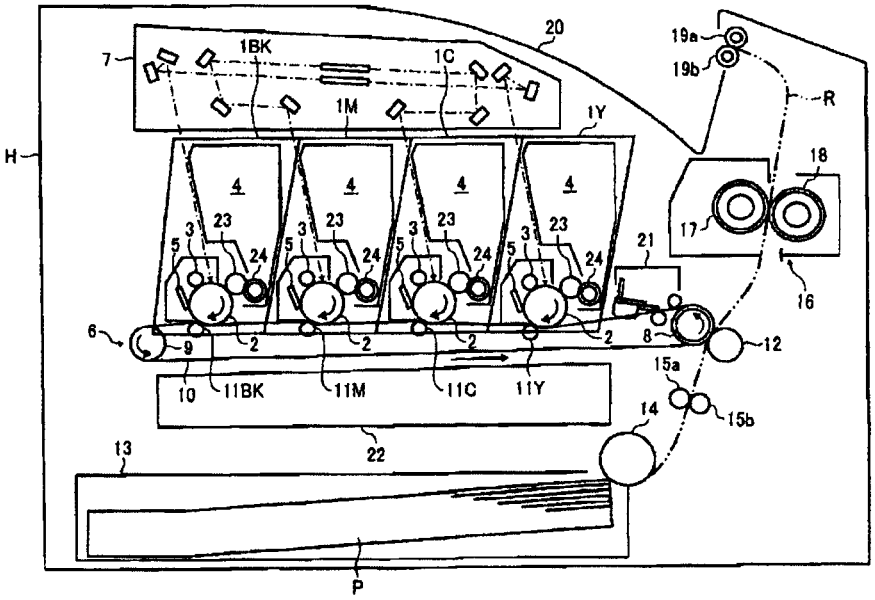

CONVENTIONAL EXAMPLE

CONVENTIONAL EXAMPLE